US012503299B1

(12) United States Patent
Becraft et al.

(10) Patent No.: US 12,503,299 B1
(45) Date of Patent: Dec. 23, 2025

(54) BARREL WITH ACCESS MECHANISM

(71) Applicants: David Becraft, Romney, WV (US); Lisa Becraft, Romney, WV (US)

(72) Inventors: David Becraft, Romney, WV (US); Lisa Becraft, Romney, WV (US)

( * ) Notice: Subject to any disclaimer, the term of this patent is extended or adjusted under 35 U.S.C. 154(b) by 311 days.

(21) Appl. No.: 18/141,976

(22) Filed: May 1, 2023

(51) Int. Cl.
*B65D 88/60* (2006.01)

(52) U.S. Cl.
CPC ..... *B65D 88/60* (2013.01)

(58) Field of Classification Search
CPC ..... B65D 43/18; B65D 43/20; B65D 43/26; B65F 1/1646; B65F 1/163; B67D 7/645; B67D 7/64
USPC ..... 220/694, 262, 495.09
See application file for complete search history.

(56) References Cited

U.S. PATENT DOCUMENTS

| | | | | |
|---|---|---|---|---|
| 3,938,768 | A | 2/1976 | Babcock | |
| 4,106,648 | A | 8/1978 | Dickson | |
| 4,744,701 | A | 5/1988 | Chasteen | |
| 6,196,407 | B1 * | 3/2001 | Liu | B65F 1/0066 220/524 |
| 6,988,865 | B2 | 1/2006 | Cardwell | |
| 9,309,048 | B2 * | 4/2016 | Mashburn | B65F 1/06 |
| 10,239,681 | B2 | 3/2019 | Thompson | |
| 10,926,948 | B2 | 2/2021 | McKee et al. | |
| 11,034,575 | B2 | 6/2021 | Hausner et al. | |
| 2008/0221544 | A1 * | 9/2008 | Dommerholt | B65F 1/02 604/385.13 |

* cited by examiner

*Primary Examiner* — Anthony D Stashick
*Assistant Examiner* — Raven Collins
(74) *Attorney, Agent, or Firm* — Cramer Patent & Design, PLLC.; Aaron R. Cramer

(57) ABSTRACT

A barrel with access mechanism is a device by which bulk products and materials are more easily accessed and removed from large drum containers. The device provides the drum with an inner plastic liner. The liner would be made available in two formats. The first, used with liquids, fine powders and the like, would be made of an accordion like side material that collapses upon itself. The second version, used for larger bulk materials, would consist of two overlapping side liners that slide over one other. In both cases, as the material in the barrel is consumed or removed, the bottom of the barrel raises up so that material on the bottom can be more easily removed, even by those who are small in stature. The device is equipped with a motor that drives at least two threaded rods, synchronized together, which raise and lower the bottom. The device can be driven by 120 VAC or 12 VDC. At any time or when the material is completely removed, the bottom can be lowered allowing the barrel to be refilled.

11 Claims, 5 Drawing Sheets

BARREL WITH ACCESS MECHANISM

RELATED APPLICATIONS

None.

FIELD OF THE INVENTION

The present invention relates generally to a barrel and more specifically to a barrel with an access mechanism which permits a user to easily access items located at the bottom of the barrel.

BACKGROUND OF THE INVENTION

There are a wide variety of liquid products that are stored, transported, and distributed in bulk. Many of these products are held in large fifty-five-gallon barrels made of steel or plastic. While such containers are ideal for transporting large quantities, they are somewhat difficult to access especially when the product level drops. A user has to reach inside a drum which is usually more than thirty-four inches off of the floor and then reach all the way to the bottom. This task is impossible for those who are small of stature, disabled, elderly, or the like. Accordingly, there exists a need for a means by which products stored in barrels can be easily accessed even at items at the bottom. The development of the barrel with access mechanism fulfills this need.

SUMMARY OF THE INVENTION

To achieve the above and other objectives, the present invention provides for a barrel with an access mechanism having a barrel and a barrel insert consisting of an upper and a lower insert, which is a container for a product (such as livestock feed) that lifts the product within the barrel to reduce the effort required to remove it as it is consumed. The barrel also includes a lifting mechanism with a piston, lifter base, foot actuator, and tether that lifts the lower insert to bring the product closer to the top of the barrel. The upper insert couples to the top of the barrel and the lower insert slides vertically within it. The lower insert has a wall and bottom that form a hollow cylinder, with a piston tower creating a piston cavity beneath the lower insert bottom to provide clearance for the lifting mechanism. The piston and lifter base are positioned under the lower insert and within the piston cavity created by the piston tower.

The barrel may have an upper insert and a lower insert that slide vertically within the upper insert. The lifting mechanism includes a piston, a lifter base, a foot actuator, and a tether. The lower insert has a contoured bottom with radial segments and feet to create clearance for the tether. The lifting mechanism operates with an electric linear actuator, battery, external DC power supply, or AC outlet. The barrel also includes a gasket to prevent product from passing between the upper and lower inserts.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
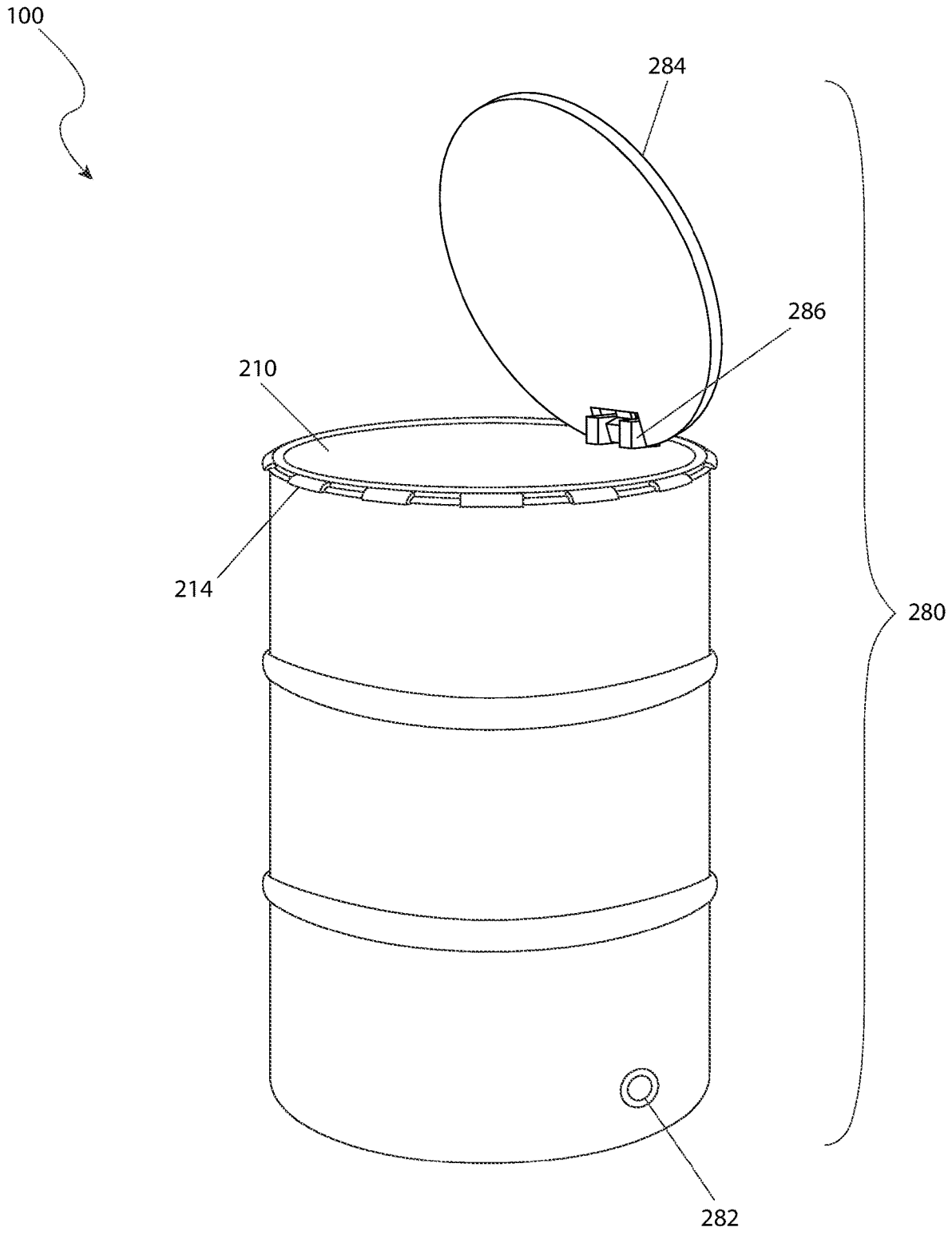
FIG. 1 is an isometric view of a barrel with access mechanism, according to an embodiment of the present invention, illustrating a pre-configured barrel.
Figure 2:
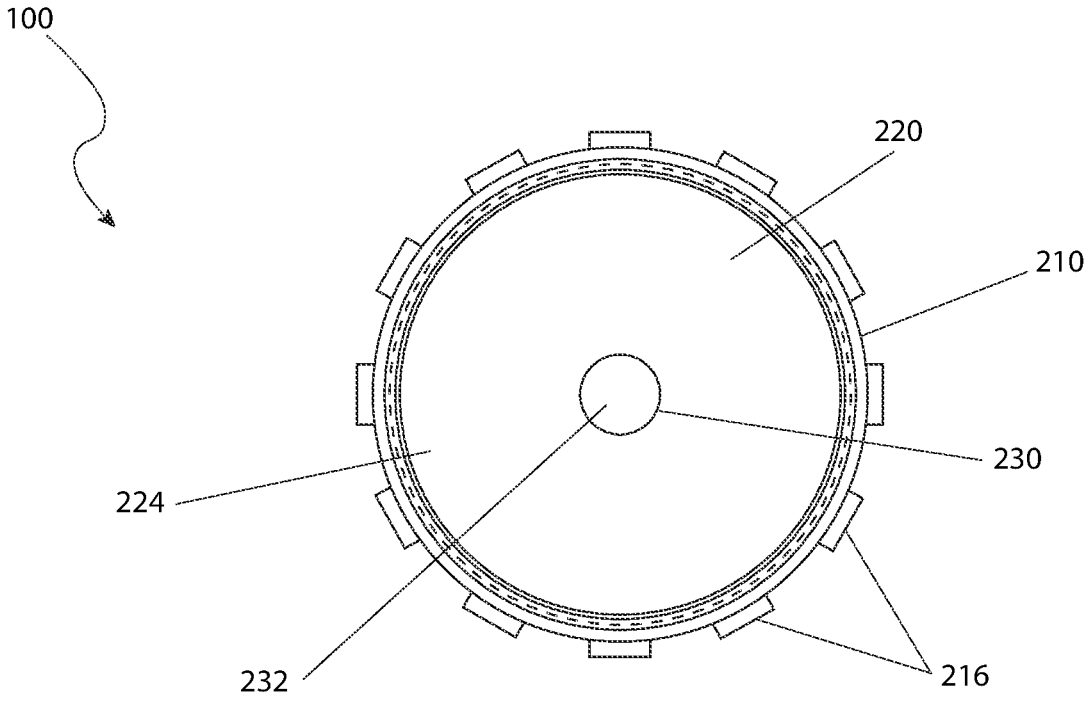
FIG. 2 is a top view of a barrel with access mechanism, according to an embodiment of the present invention.
Figure 3:
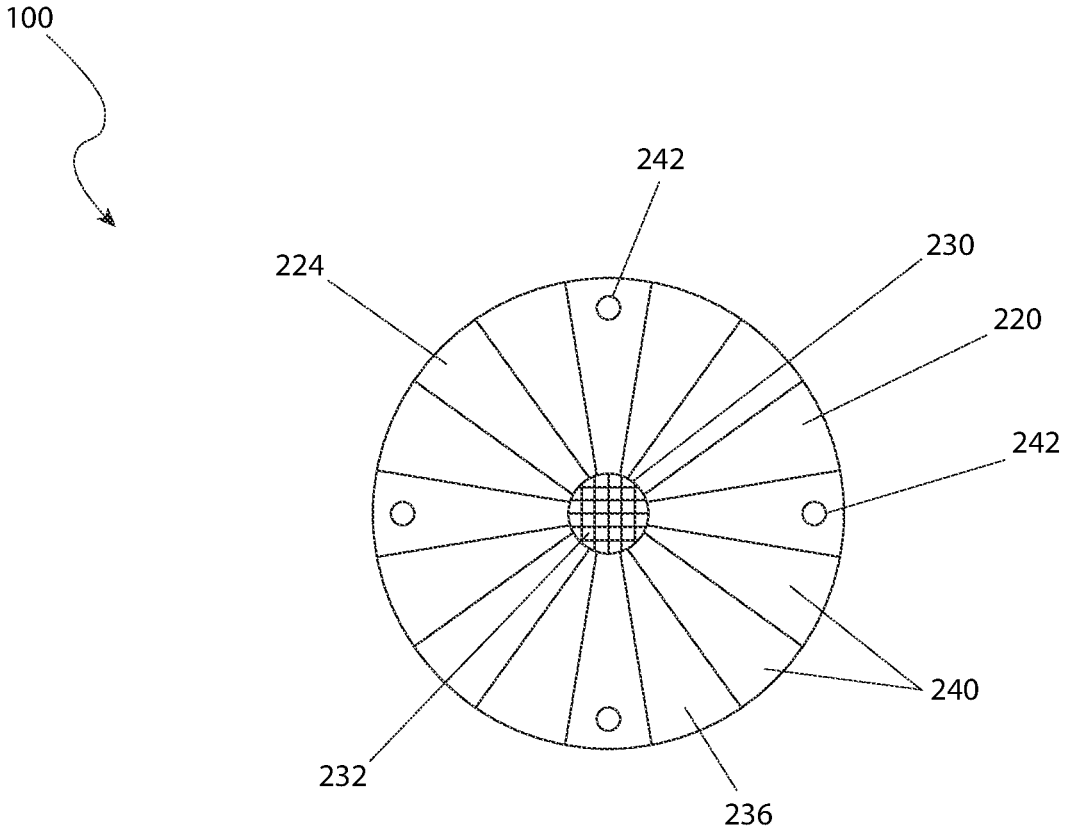
FIG. 3 is a bottom view of a barrel with access mechanism, according to an embodiment of the present invention.
Figure 4:
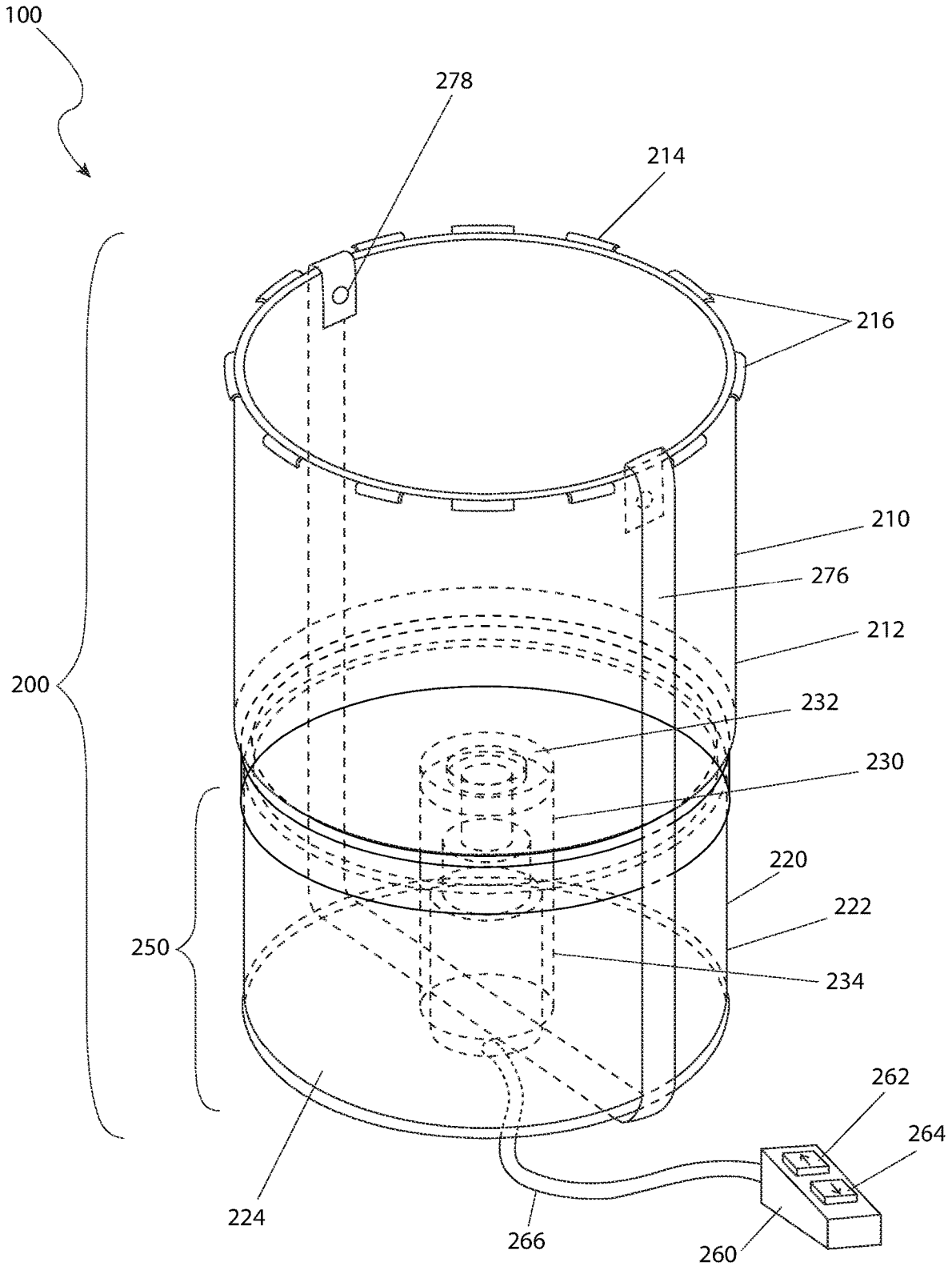
FIG. 4 is a detail view of a barrel with access mechanism, according to an embodiment of the present invention, illustrating the lower insert in a lowered position.
Figure 5:
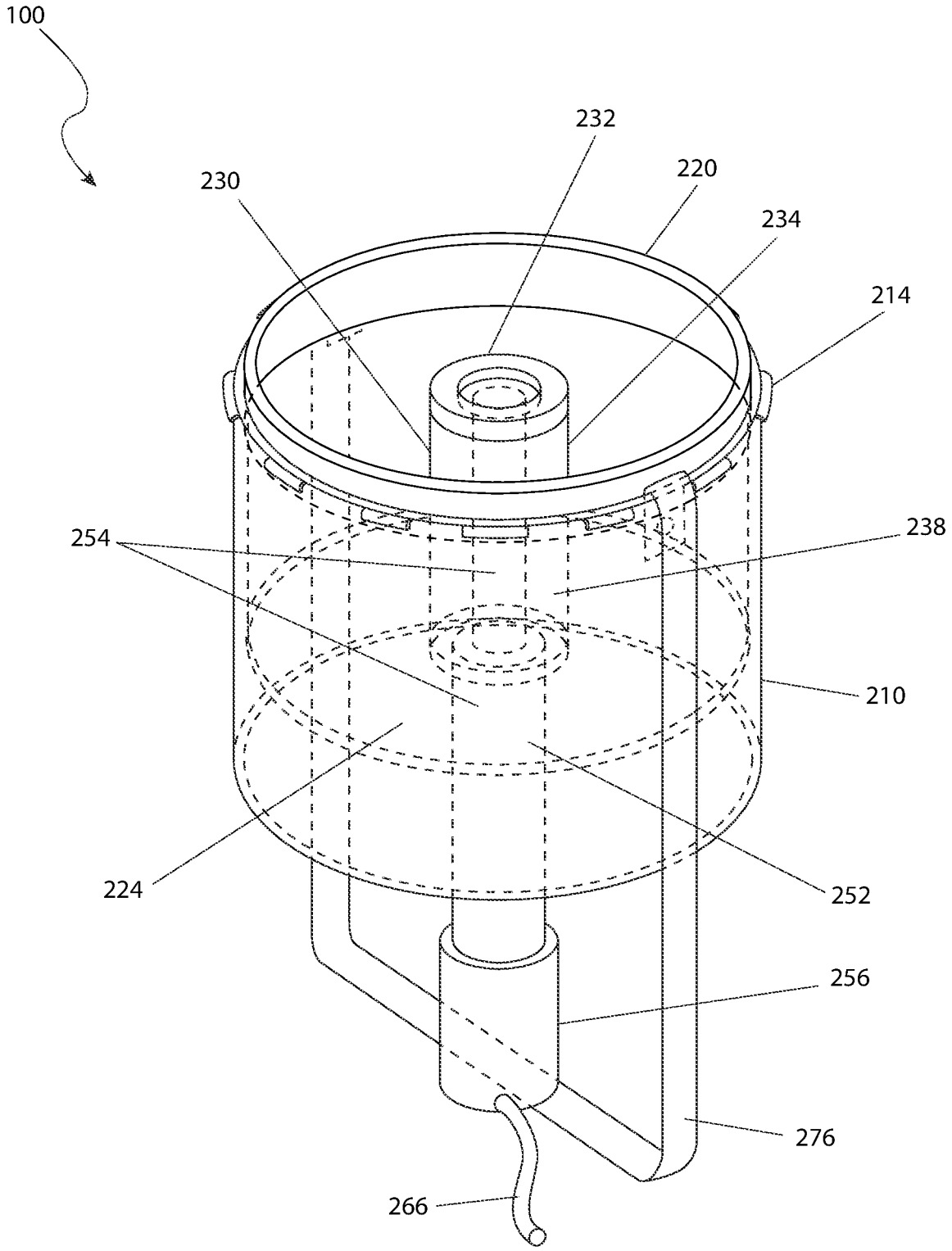
FIG. 5 is a detail view of a barrel with access mechanism, according to an embodiment of the present invention, illustrating the lower insert in a raised position.
Figure 6:
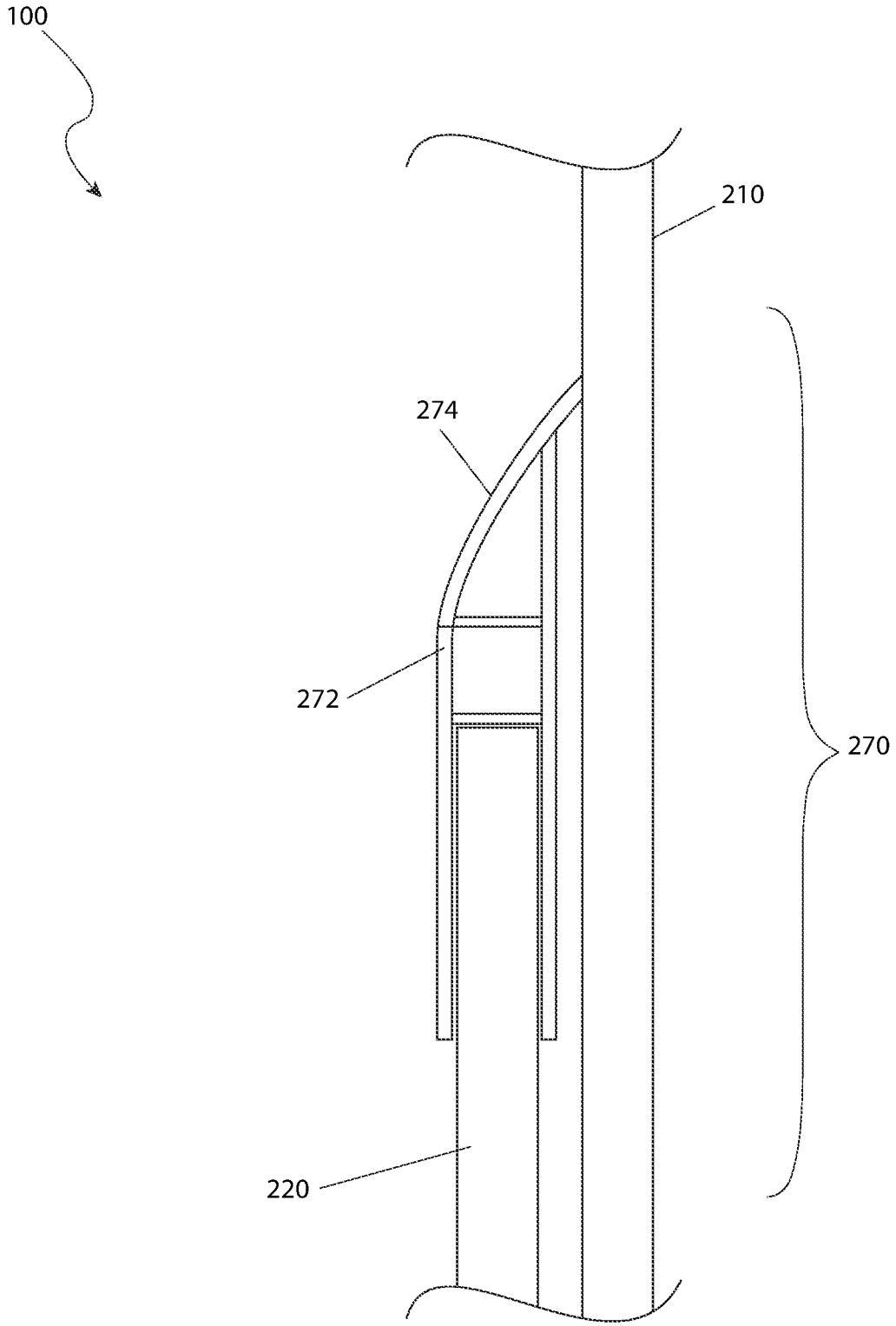
FIG. 6 is a detail view of a barrel with access mechanism, according to an embodiment of the present invention, illustrating the gasket.

100 barrel with insert
200 barrel insert
210 upper insert
212 upper insert wall
214 flange
216 plurality of flange segments
220 lower insert
222 lower insert wall
224 lower insert bottom
230 piston tower
232 center disk
234 connecting wall
236 contoured bottom
238 piston cavity
240 radial segment
242 foot
250 lifting mechanism
252 piston
254 telescoping segment
256 lifter base
260 foot actuator
262 up control
264 down control
266 tether
270 gasket
272 gasket retainer
274 pliable seal
276 retention strap
278 coupling point
280 pre-configured barrel
282 tether port
284 lid
286 hinge

DESCRIPTION OF THE INVENTION

The present invention is directed to a barrel with an insert (herein described as the "invention") 100. The invention 100 may comprise a barrel insert 200 and a lifting mechanism 250. The barrel insert 200 may be operable to lift a product within a barrel thereby reducing the effort required to remove the product from the barrel as the product is consumed. The barrel insert 200 may comprise an upper insert 210 and a lower insert 220 that form a container for the product. The upper insert 210 may couple to the top of the barrel and the lower insert 220 may slide vertically within the upper insert 210. The lower insert 220 may be lifted by the lifting mechanism 250 to bring the product closer to the top of the barrel. As non-limiting examples, the product may be feed for livestock such as cattle, pigs, horses, and goats or for poultry such as chickens, ducks, and turkeys, or any lightweight product such as cat litter, saw dust, oil absorbent etc.

The barrel insert 200 may comprise the upper insert 210 and the lower insert 220. The upper insert 210 may comprise an upper insert wall 212 that forms a hollow cylinder open at both the top and bottom. The upper insert 210 may couple to the top of the barrel to line the inside of the top of the barrel. The upper insert 210 may comprise a flange 214. The flange 214 may extend over the top of the barrel in order to suspend the upper insert 210 within the barrel. In some embodiments, the flange 214 may comprise plurality of flange segments 216.

The lower insert 220 may comprise a lower insert wall 222 and a lower insert bottom 224. The lower insert wall 222 may form a hollow cylinder that is open at the top and closed off at the bottom by the lower insert bottom 224.

The upper insert outside diameter may be smaller than the inside diameter of the barrel such that the upper insert 210 may fit within the barrel. The lower insert outside diameter may be smaller than the upper insert inside diameter such that the lower insert 220 may slide within the upper insert 210.

The lower insert bottom 224 may comprise a piston tower 230 which may be an upward projection of the center of the lower insert bottom 224. The piston tower 230 may create a piston cavity 238 beneath the lower insert bottom 224 to provide clearance for the lifting mechanism 250. The piston tower 230 may comprise a center disk 232 and a connecting wall 234. The center disk 232 may be a horizontally oriented circular plate that the lifting mechanism 250 may push upward against. The connecting wall 234 may couple the center disk 232 to the lower insert bottom 224.

In some embodiments, the bottom of the center disk 232 may be reinforced to withstand pressure applied by the lifting mechanism 250. In some embodiments, the lower insert bottom 224 may comprise a contoured bottom 236 to provide rigidity. As a non-limiting example, the contoured bottom 236 may comprise plurality of radial segments 240 having alternating heights.

The lower insert bottom 224 may comprise a plurality of feet 242 located on the underside of the lower insert 220. The plurality of feet 242 may create a gap under the lower insert 220. The gap may provide clearance for a tether 266 that may interconnect the lifting mechanism 250 located under the lower insert 220 and a foot actuator 260 located outside of the barrel.

The lifting mechanism 250 may comprise a piston 252, a lifter base 256, the foot actuator 260, and the tether 266. The piston 252 and the lifter base 256 may be positioned under the lower insert 220 and within the piston cavity 238 created by the piston tower 230. The piston 252 may extend and retract from the lifter base 256 responsive to actuations of the foot actuator 260. The tether 266 may convey actuations of the foot actuator 260 to the lifter base 256.

The piston 252 may be a vertically oriented cylinder that is operable to increase and decrease in length in order to lift the lower insert 220. The piston 252 may comprise one (1) or more telescoping segments 254. In some embodiments, retraction of the piston 252 may be spring assisted.

The foot actuator 260 may comprise an up control 262 that may be adapted to be actuated by a user's foot to extend the piston 252. In some embodiments, the foot actuator 260 may comprise a down control 264 that may be adapted to be actuated by the user's foot to retract the piston 252. The foot actuator 260 may be positioned outside of the barrel. The foot actuator 260 may be coupled to the lifter base 256 via the tether 266 which may pass through an access port located in the side of the barrel.

In some embodiments, the lifting mechanism 250 may be an electrically operated lifter. As a non-limiting example, the electrically operated lifter may be an electric linear actuator. The electric linear actuator may comprise a motor that may rotate a lead screw via a gear box. Rotation of the motor in a first rotational direction may cause the lead screw to extend the piston 252 and rotation of the motor in a second rotational direction may cause the lead screw to retract the piston 252. In some embodiments, the electrically operated lifter may comprise one (1) or more limit switches to limit the distance that the piston 252 may extend, retract, or both.

As non-limiting examples, the electrically operated lifter may be powered from a power source comprising a battery, an external DC power supply, or an AC outlet.

In some embodiments, the lifting mechanism 250 may be a fluidly operated lifter. The fluidly operated lifter may move the piston 252 using a compressed fluid. The compressed fluid may be moved by a pump. The fluidly operated lifter may comprise one (1) or more valves to control the compressed fluid such that the compressed fluid may extend the piston 252, may retract the compressed fluid, or both.

As a non-limiting example, the fluidly operated lifter may comprise a hydraulic lifter. The hydraulic lifter may utilize hydraulic fluid as the compressed fluid. The pump may pump the hydraulic fluid from a hydraulic fluid reservoir to the lifter base 256 to extend the piston 252 and from the lifter base 256 to the hydraulic fluid reservoir to retract the piston 252. The foot actuator 260 may control activation and pumping direction of the pump.

As a non-limiting example, the fluidly operated lifter may comprise a pneumatic lifter. The pneumatic lifter may utilize a compressed gas as the compressed fluid. As a non-limiting example, the compressed gas may be compressed air. In some embodiments, the foot actuator 260 may be a foot-operated pump.

The invention 100 may further comprise a gasket 270. The gasket 270 may be operable to prevent the product from passing between the upper insert 210 and the lower insert 220. The gasket 270 may couple to the top rim of the lower insert 220. The gasket 270 may comprise a gasket retainer 272 and a pliable seal 274. The gasket retainer 272 may couple to the lower insert 220 and may hold the pliable seal 274 in place. The pliable seal 274 may press against the upper insert 210 to block the product from passing between the upper insert 210 and the lower insert 220. The pliable seal 274 may slide along the upper insert wall 212 as the lower insert 220 is raised and lowered. In some embodiments, the gasket 270 may be detachable and/or replaceable by pulling the gasket retainer 272 off of the lower insert 220.

The invention 100 may further comprise a retention strap 276. The retention strap 276 may be operable to prevent the upper insert 210 from being lifted by upward movement of the lower insert 220. The retention strap 276 may couple to the top of the upper insert 210 at a plurality of coupling points 278 and may pass under the barrel.

In some embodiments, the invention 100 may further comprise a pre-configured barrel 280. The pre-configured barrel 280 may comprise a tether port 282 for the tether 266 to pass from the outside of the pre-configured barrel 280 to the inside of the pre-configured barrel 280. The pre-configured barrel 280 may further comprise a lid 284 that may be hingedly coupled to the top of the pre-configured barrel 280 via a hinge 286. As a non-limiting example, the lid 284 may be closed to protect the product stored within the pre-configured barrel 280 from exposure to the elements.

In use, the lifting mechanism 250 may be placed at the bottom center of a barrel and the tether 266 may be coupled between the lifting mechanism 250 and the foot actuator 260 located outside of the barrel. The upper insert 210 may be positioned at the top of the barrel and the lower insert 220 may be lowered into the upper insert 210 such that the piston 252 of the lifting mechanism 250 is inserted into the piston tower 230 of the lower insert 220. A product such as feed for livestock such as cattle, pigs, horses, and goats or for poultry such as chickens, ducks, and turkeys, or any lightweight product such as cat litter, saw dust, oil absorbent etc., may be placed into the barrel. Initially, the product may be easily accessible at the top of the barrel. However, as the product is consumed the level of the product within the barrel may be lowered. Eventually, the level of the product may be so low that it is difficult to a user to reach. The user may actuate the foot actuator 260 to lift the lower insert 220, thus pushing the product up within the barrel until the top of the product is easily accessible by the user. The user may lower the lower insert 220 in order to create space for refilling the barrel.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A barrel, comprising:

a barrel insert having an upper insert and a lower insert, the barrel insert is a container for a product lifting the product within the barrel thereby reducing effort required to remove the product from the barrel as the product is consumed; and, a lifting mechanism having a piston, a lifter base, a foot actuator, and a tether, the lifting mechanism lifts the lower insert of the barrel to bring the product closer to the top of the barrel and, wherein the lower insert includes a lower insert wall and a lower insert bottom that forms a hollow cylinder that is open at the top and closed off at the bottom by the lower insert bottom;

wherein the lower insert bottom includes a piston tower with a center disk and a connecting wall which is in an upward projection of the center of the lower insert bottom;

wherein the piston tower creates a piston cavity beneath the lower insert bottom to provide clearance for the lifting mechanism;

wherein the piston and the lifter base is positioned under the lower insert and within the piston cavity created by the piston tower;

wherein the connecting wall couples the center disk to the lower insert bottom;

wherein the lower insert bottom includes a contoured bottom to provide rigidity and include a plurality of radial segments having a plurality of alternating heights;

wherein the lower insert bottom includes a plurality of feet located on the underside of the lower insert to create a gap under the lower insert to provide clearance for a tether that interconnects the lifting mechanism located under the lower insert and the foot actuator located outside of the barrel;

wherein the center disk is a horizontally oriented circular plate that the lifting mechanism pushes upward against; and, wherein the bottom of the center disk is reinforced to withstand pressure applied by the lifting mechanism.

2. The barrel, according to claim 1, wherein the upper insert couples to the top of the barrel and the lower insert slides vertically within the upper insert.

3. The barrel, according to claim 1, wherein the upper insert includes a flange that extends over the top of the barrel in order to suspend the upper insert within the barrel.

4. The barrel, according to claim 3, wherein the flange includes a plurality of flange segments.

5. The barrel, according to claim 1, wherein the product is a feed for livestock selected from the group consisting of a plurality of cattle, a plurality of pigs, a plurality of horses, a plurality of goats, a plurality of poultry, a plurality of chickens, a plurality of ducks, and a plurality of turkeys or a lightweight product such as cat litter, saw dust, oil absorbent etc.

6. The barrel, according to claim 1, wherein the upper insert outside diameter is smaller than the inside diameter of the barrel such that the upper insert is within the barrel.

7. The barrel, according to claim 1, wherein the lower insert outside diameter is smaller than the upper insert inside diameter such that the lower insert slides within the upper insert.

8. The barrel, according to claim 1, wherein an electrically operated lifter is powered from a power source selected from the group consisting of an electric linear actuator, a battery, an external DC power supply, or an AC outlet.

9. The barrel, according to claim 8, wherein the piston extends and retracts from the lifter base responsive to the foot actuator and the tether conveys one or more actuations of the foot actuator to the lifter base.

10. The barrel, according to claim 1, further comprising a gasket operable to prevent the product from passing between the upper insert and the lower insert and couple to the top rim of the lower insert.

11. The barrel, according to claim 10, wherein the gasket includes a gasket retainer and a pliable seal.

* * * * *